US010183307B2

(12) United States Patent
Duss et al.

(10) Patent No.: US 10,183,307 B2
(45) Date of Patent: Jan. 22, 2019

(54) METHOD FOR APPLYING A FLOWABLE SUBSTANCE

(71) Applicant: Mueller Martini Holding AG, Hergiswil (CH)

(72) Inventors: Hanspeter Duss, Buchs (CH); Philipp Aebersold, Villmergen (CH)

(73) Assignee: Mueller Martini Holding AG, Hergiswil (CH)

( * ) Notice: Subject to any disclaimer, the term of this patent is extended or adjusted under 35 U.S.C. 154(b) by 345 days.

(21) Appl. No.: 14/553,576

(22) Filed: Nov. 25, 2014

(65) Prior Publication Data

US 2015/0151320 A1 Jun. 4, 2015

(30) Foreign Application Priority Data

Nov. 29, 2013 (CH) ..... 1988/13

(51) Int. Cl.

| | |
|---|---|
| ***B05C 5/00*** | (2006.01) |
| ***B05B 15/02*** | (2006.01) |
| ***B05B 1/00*** | (2006.01) |
| ***B05B 15/55*** | (2018.01) |
| *B05C 5/02* | (2006.01) |

(52) U.S. Cl.

CPC ..... *B05B 15/0266* (2013.01); *B05B 1/00* (2013.01); *B05B 15/557* (2018.02); *B05C 5/001* (2013.01); *B05C 5/0208* (2013.01)

(58) Field of Classification Search

USPC ..... 427/207.1, 421.1

See application file for complete search history.

(56) References Cited

U.S. PATENT DOCUMENTS 3,876,144 A * 4/1975 Madden ..... B21D 51/46 118/302
4,031,854 A * 6/1977 Sprague, Jr. ..... A43D 25/18 118/302
4,408,562 A * 10/1983 DeCamp ..... B05C 5/02 118/324

(Continued)

FOREIGN PATENT DOCUMENTS

DE 19936670 C1 2/2001
EP 0719592 A2 12/1995

(Continued)

OTHER PUBLICATIONS

Office Action dated Jul. 18, 2018, in Japanese Patent Application No. 2014-239507 (submitted with English translation).

*Primary Examiner* — Brian K Talbot
(74) *Attorney, Agent, or Firm* — FisherBroyles, LLP; Robert Kinberg

(57) ABSTRACT

A method and apparatus for applying a flowable substance to a flat or curved product using a nozzle unit. The nozzle unit includes a nozzle valve that has a nozzle end with an outlet opening. Moist air and/or temperature-moderated air is admitted to a zone of the nozzle end to form condensation when the supplied moist and/or temperature-moderated air hits the nozzle end zone. Drying up or agglutinating of the flowable substance is thereby prevented at the outlet opening of the nozzle end to secure a continuous, unobstructed flow of the flowable substance from the outlet opening.

13 Claims, 3 Drawing Sheets

(56) References Cited

U.S. PATENT DOCUMENTS 4,517,917 A * 5/1985 Santefort ..... B05C 5/02 118/300
4,527,510 A * 7/1985 Arndt ..... B05C 11/1021 118/324
5,418,009 A * 5/1995 Raterman ..... B42C 9/0006 118/324
5,447,254 A * 9/1995 Hoover ..... B05C 5/0225 222/1
5,989,647 A * 11/1999 Remy ..... F25D 3/10 118/302
6,040,016 A * 3/2000 Mitani ..... B05B 7/02 118/313
6,149,076 A * 11/2000 Riney ..... B05B 7/0861 239/135
8,632,157 B2 * 1/2014 Uraki ..... B41J 2/15 347/18
2002/0142341 A1 * 10/2002 Kameyama ..... B01J 19/0046 435/6.11
2003/0127530 A1 * 7/2003 Heide ..... B05B 15/0258 239/1
2007/0285456 A1 * 12/2007 Takasu ..... B41J 2/04553 347/19
2008/0023034 A1 * 1/2008 Hirao ..... H01L 21/67051 134/11
2008/0210774 A1 9/2008 Dale et al.
2012/0062640 A1 * 3/2012 Uraki ..... B41J 2/15 347/18
2013/0129916 A1 * 5/2013 Katsumura ..... H05K 3/125 427/98.4
2014/0049579 A1 * 2/2014 Jinushi ..... B41J 2/0454 347/18
2014/0368574 A1 * 12/2014 La Vos ..... B41J 2/165 347/25

FOREIGN PATENT DOCUMENTS

EP 2006030 A2 12/2008
EP 2248598 A1 11/2010
JP H10-174904 A 6/1998
JP 2005-212138 A 8/2005
JP 2007-317706 A 12/2007
JP 2008-132448 A 6/2008

* cited by examiner

METHOD FOR APPLYING A FLOWABLE SUBSTANCE

CROSS-REFERENCE TO RELATED APPLICATIONS

This application claims priority to Swiss Application No. 01988/13, filed Nov. 29, 2013, the disclosure of which is incorporated here by reference in its entirety.

BACKGROUND OF THE INVENTION

Technical Field

For the production of a book or printed product, individual pages and/or sheets are printed and collated to form a loose book block. The loose pages and/or sheets within the stack formed in this way are aligned, relative to each other, in a perfect binder. The pages or sheets are then held in place with a clamp and moved across processing stations in which the spine of the printed product is machined and glue is applied.

Digital printing technology has made it possible to print and collate the pages and/or sheets in series, such that they respectively contain the content of a complete book or printed product. These loose stacks of pages and/or sheets are not very suitable to be transported or stacked without falling apart or without sliding around internally.

For that reason, an auxiliary gluing together of the individual pages and/or sheets has proven suitable to join, respectively integrate, the individual parts of a book block to form a single book block.

This auxiliary gluing together can take place in different ways. One proven technique is to apply drops of cold glue to the outside surfaces of the pages and/or the sheets in the printed product section. The individual pages and/or sheets, which are stacked one above the other, are glued together with these cold glue drops and thus form a relatively stable book block which is easy to handle during the further process for producing a bound book.

To apply the cold glue drops to the paper, nozzle valves are used which, however, are notorious for becoming dirty and thus frequently fail to meet the final objective.

Prior Art

European patent document EP 0719 592 A2 discloses a nozzle unit for processing flowable substances, in particular glue. To prevent glue residues from hardening inside the nozzle unit during a temporary interruption in the operation, a liquid, and in particular water, is squirted into the nozzle channel so that glue is flushed from an end section on the nozzle outlet. By closing off the nozzle channel, a column of water remains inside the nozzle channel, thereby sealing it against the outside. For a renewed use of the nozzle, the closing device is removed and the water column is pushed out by the renewed pumping of glue. A device of this type solves the problem of plugging up the nozzle outlet opening with hardened glue during breaks in the operation. However, the device cannot prevent the nozzle from becoming dirty in the area of the outlet opening. Glue residues collect at the outlet opening, harden thereon, and then deflect the flowing-out glue stream which further promotes contamination of the nozzle, thus causing the nozzle to be plugged within a short time. A secure glue exit can be ensured only if the glue residues are periodically removed. The length of time between the cleaning intervals can be very short, depending on the type of glue that is used and the prevailing environmental conditions.

An apparatus for applying flowable substances, in particular glue, to a substrate is disclosed in the German patent document DE 199 36 670 C1. This apparatus has a fixed support arm and a thereto connected metering valve. According to this document, the metering valve is arranged on the support arm, so as to pivot around an axis. During the pivoting movement from the working position to the resting position, the outlet opening on the nozzle of the metering valve slides over the cleaning segment of a rubber element and is thus freed of any adhering glue residues. In the resting position, the outlet opening is closed off by the smooth segment of the rubber element. The rubber element is preferably arranged on a spring-elastic holder. This arrangement prevents the clogging of the nozzle outlet opening during interruptions in the operation because the opening is closed off and the residual glue consequently does not dry out and harden inside the bore for the outlet opening. By moving the nozzle outlet opening across the cleaning segment of the rubber element, hardened or dried glue residues are scraped off the nozzle. However, this apparatus has the disadvantage that in order to wipe off the glue residues, the nozzle must be pivoted from the operating position to the resting position and back again. During this movement, the nozzle cannot be used for applying glue to the substrate. It has furthermore turned out that the glue residues relatively quickly dirty the rubber element and that this element must be cleaned frequently.

A similar apparatus is described in European patent document EP 2 006 030 A2. In that case, the metering valve with the outlet opening for the glue, paint or varnish is arranged immovably. A pivoting outside closing device can be moved between a resting position and an operating position, wherein the outlet opening on the metering valve is closed off during the resting position by the outside closing device. This apparatus also has the same disadvantages as the apparatus disclosed in the DE 1 99 36 670 C1.

An apparatus and a method for dispensing a moisture-hardening glue is known from European patent document EP 2 248 598 A1. The apparatus is provided with several nozzle openings which can be operated in two operating modes. In one operating mode, not all nozzle openings are operational, so that precautions must be taken to ensure that the unused nozzle openings will not be gummed up. Residual glue remaining on the outlet opening of the nozzle comes in contact with the ambient air that contains moisture and thus hardens. The hardening of the glue is prevented with the aid of a flow chamber in the region of the nozzle opening by blowing a gas into this flow chamber, which then washes around the nozzle outlet opening containing the residual glue, thereby preventing the moisture in the air from coming in contact with the glue. This apparatus is designed for and has proven itself for use with moisture-hardening glues such as PUR (polyurethane reactive) glue and the like. However, this apparatus is not suitable for use with cold glues which harden through drying. Experiments have shown that using dry air or a gas to wash around the outlet opening of a nozzle valve which dispenses cold glue does not prevent the contamination of the nozzle with glue residue, but rather promotes it.

SUMMARY OF THE INVENTION

The invention is intended to solve the foregoing problems. It is an object of the invention to prevent the contamination or clogging of nozzle valves, used to apply a flowable substance, in particular glue and especially cold glue, in order to ensure a high and guaranteed availability of the system for applying the glue, without having to resort to manual or mechanical cleaning operations of the nozzles during the course of the production or during production interruptions.

According to an embodiment of the invention, there is provided a method for applying a flowable substance to a flat or curved product, using a nozzle unit including a nozzle valve having a nozzle end with an outlet opening, the method comprising: admitting at least one zone of the nozzle end to at least one of moist air and temperature-moderated air to form condensation when the supplied moist and/or temperature-moderated air hits the nozzle end zone thereby preventing a drying up or agglutinating of the flowable substance at the outlet opening of the nozzle end to secure a continuous, unobstructed flow of the flowable substance from the outlet opening.

According to another aspect of the invention there is provided an apparatus for realizing a method for applying a flowable substance to a flat or curved product, the apparatus including, according to one embodiment: a nozzle unit including a nozzle valve having a nozzle end with an outlet opening, the nozzle end having at least one cooling zone; a mechanism to supply the at least one cooling zone with at least one of moist and temperature-moderated air so that condensation water forms as a result of the impact between the supplied moist and/or temperature-moderated air and the at least one cooling zone; and a discharge device to which the nozzle end is operatively connected which is adapted to discharge the condensation water or the condensation water loaded with dirt particles for ensuring a continuous, unobstructed flow of the flowable substance from the nozzle outlet opening.

The solution according to the invention is based on findings that a nozzle can easily get clogged in particular, but not only, during a stop in the operation of the nozzle valve. If no glue is ejected over a longer period of time, the glue remaining in the nozzle outlet opening can dry out and form a plug which then persistently closes off the nozzle opening. Needle valves, which allow closing off the nozzle outlet opening with a pin as needed, could be used per se to better ensure that the nozzle outlet opening remains clear. However, it has turned out that a nozzle outlet opening provided with this type of infrastructure can still be clogged up easily with lumpy glue residues, thus rendering it unusable for the operation.

A method and an apparatus are therefore proposed according to the invention which prevent a contamination with dirt and plugging up of the outlet openings of nozzle valves in that continuously or at least intermittently operation-specific precautions are taken with respect to the nozzle end and the nozzle outlet opening, so that the nozzle end is cooled intermittently or continuously and, at the same time, this nozzle end is also admitted intermittently or continuously with moist and/or temperature-moderated air.

Meanwhile, the active cooling of the nozzle end should not be understood as an absolute measure because, with given temperature differences between the nozzle end and the ambient air for forming condensation water, or if the supplied air is saturated sufficiently with moisture, it is possible to omit the cooling of at least one zone of the nozzle end. This can be achieved, for example, by treating the air with the aid of a fog or mist generator or a water-fed ultrasonic atomizer.

Thus, if reference is made in the following to a cooling of the nozzle end zone, it only means that a preferred embodiment of the invention is given priority.

The condensation water (also called perspiration water) is a moist, fog-like precipitation on objects, wherein condensation water always forms if moist, warm air hits a cold or colder surface. Warm air can bind considerably more water than cold air. If the warm air cools down, the excessive share of water in the air precipitates out in the form of condensation water.

In one embodiment of the invention, at least one zone of the nozzle end is subjected to cooling and is admitted with moist and/or temperature-moderated air, such that an amount of condensation water forms owing to the impact of the supplied moist and/or temperature-moderated air and the cooled zone of the nozzle end, wherein this condensation water is the reason why a drying out or agglutinating of the flowable substance at the outlet opening of the nozzle end is continually counteracted.

Thus, the invention is intended to provide a remedy to counteract the obvious shortcomings according to the prior art, which is that the nozzle valve, and in particular its outlet opening, can easily be contaminated with dirt or clogged, especially when applying cold glue to paper.

The solution according to the invention provides the option of completely omitting a manual or other type of cleaning of the nozzles during the production or to dispense with production interruptions for the purpose of cleaning, thereby making it possible to maintain high productivity.

In the present case, the nozzle valve forms a component of a comprehensive nozzle unit which also contains further functional elements, such as a glue supply line, a moist air generator, a dry air supply line, a water supply line, a discharge device, and so forth as illustrated in the accompanying drawings and described below.

As a rule, the contamination is caused by glue residues which collect and dry on in the region of the nozzle outlet opening and can furthermore mix with dust particles from the ambient air. A paste-like mixture of this type is predestined to dry out easily, so that over time lumps can develop which adhere to the opening of the nozzle outlet and thus can completely stop or substantially divert the supply of glue exiting the nozzle outlet opening, which results in faulty operations for the specific glue application.

It has furthermore been observed in this connection that glue residues in the form of drops or plugs that are suspended in the region of the nozzle outlet opening are unstable and can drop off from to time during the production, thereby resulting in an uncontrolled gluing together of the products or to contamination with dirt of the products.

According to the invention, the condensation water precipitated out in the region of the nozzle end and the nozzle outlet opening subsequently flows off and, in the process, pulls along dirt particles and any glue residues in particular up to the nozzle opening, thereby resulting in a continuous cleaning of the nozzle end as well as the nozzle outlet opening.

If the degree of contamination in the region of the nozzle outlet opening is low or insignificant, no special measures must be taken which are designed to catch the condensation water. In that case, the amount of condensation water and the degree of contamination with dirt of this condensation water do not result in disadvantages with respect to the gluing operation, so that operationally it is acceptable to allow this condensation water to be discharged along with the glue stream.

If the dirt particle load in the condensation water is at a specific level, a corresponding discharge of the condensation water must be provided by admitting the nozzle outlet opening either continuously or intermittently with a stream of air coming from the side, so as to blow away the condensation water which has collected thereon, wherein this condensation water is subsequently caught in a collection tube, arranged on the side, and is then discharged. The stream of air can thus be used intermittently and additionally with a higher pressure pulse, but should in all cases not negatively influence the consistency of the stream of glue being discharged from the nozzle opening.

If, however, it is specified that the glue supply definitely should not come in contact with the condensation water because of a specific dirt load in the condensation water, a protective discharge device is provided in that case which is focused exclusively on the discharge of condensation water contaminated with dirt in this way. This discharge device must be capable of protecting the end of the nozzle outlet opening from the condensation water that drips off or flows off, so that the glue to be applied does not come in contact with the condensation water.

A corresponding design variant according to the invention for this discharge device provides for sealing the nozzle outlet opening directly along the contour, so that the condensation water can flow off integrally via the discharge device along the circumference of the nozzle end.

With a configuration of this type, additional measures may be taken so that the nozzle outlet opening itself is subjected continuously to a metered, moist stream of air to develop a moisture-dependent lubricating effect at said location, which ensures a maximized flowability of the glue flowing out of the nozzle outlet opening. As a result, it is also ensured that not even the smallest amount of contamination can form in the region of the nozzle outlet opening which could easily mutate into crystallization points for forming lumps and plugs.

For this purpose, a metered partial amount of the moist and/or temperature moderated air is conducted via flow-through openings, for example specially installed and designed, into the inside area of the discharge device, wherein this flow of air may be focused directly onto the nozzle outlet opening that is subjected to a continuous lubricating effect because of the moisture-containing air.

The flow-through openings in the discharge device can furthermore be embodied such that the flow of air is somewhat accelerated when moving through these flow-through openings which, in turn, maximizes the lubricating effect in the region of the nozzle outlet opening. As a result, the danger of the nozzle outlet opening being closed off by glue lumps definitely has a tendency towards zero.

With such an operation, which is intended to purposely admit the nozzle outlet opening, it must be ensured that the supplied air has a high degree of purity which is achieved, for example, by enriching this air with a corresponding amount of distilled water. In any case, this air should not come in contact with condensation water loaded with dirt prior to admitting the nozzle outlet opening. It is furthermore advantageous if the air/water mixture is selected such that the requirements for a high-fogging air flow are met, which then ensures an unobstructed flow-through of the glue stream.

In this connection, it is also possible according to the invention to provide the discharge device with tangential air bores through which the air flows into the region inside the discharge device where it may form a swirling flow, for example in the region of the nozzle outlet opening, which ensures in addition to the lubricating effect a consolidation of the glue stream in the center of this swirling flow because of the cyclone effect that forms there. This swirling air flow is then discharged either axially or tangentially, relative to the axis of the nozzle outlet opening, without having any negative effect on the compactness of the glue stream.

This swirling air flow can furthermore also carry along and discharge any condensation water drops that may form on the inside wall of the discharge device.

This type of situation can occur if the nozzle outlet opening is not closed off completely or cannot be closed off completely along the contour by the discharge device, but a gap remains around the contour between the two parts through which microscopic condensation water drops can enter the inside space of the discharge device. This gap should advantageously be dimensioned such that any condensation water drops, which form on the inside wall of the discharge device and adhere thereto because of their surface tension, can be carried along easily by the injected swirling air flow.

Corresponding to the final objective of the invention, however, the goal of the invention is, on the one hand, to cool the nozzle end with the nozzle outlet opening for the glue application, as needed, using a cooling agent or a cooling device. On the other hand, the cooled nozzle end is subjected to a stream of moist and/or temperature-moderated air being blown against it or flowing around it. In all cases, the basic premise is that this stream of air has a higher temperature than the prevailing temperature at the nozzle end. The condensation water forming as a result of this impact admits the outside surface of the nozzle end and thus prevents a drying out of the glue and also the forming of glue lumps in the region of the nozzle outlet opening.

For a purposeful discharge of the condensation water as disclosed for the invention, measures are taken so that this condensation water can mix with any glue residues and other dust particles that are present, so that these can also be carried along securely in discharge direction by the flow of condensation water.

By providing a targeted discharge of the dirt-loaded condensation water, depending on the degree of contamination, the cleanliness of the nozzle outlet opening can be influenced deliberately. A high availability of the nozzle valve is thus achieved in general. This effect can furthermore be maintained during interruptions in the production operation. If no glue is ejected from the nozzle valve, the continuously forming condensation water together with a complementary blowing of air into the discharge device prevents the drying out of any glue residues that accumulate, thus completely preventing glue from clogging the nozzle outlet openings.

The measures for discharging the condensation water loaded with dirt particles, using a discharge device, must be designed and directed so that the aforementioned condensation water is securely conducted to a catch basin, arranged on the underside, and is collected therein to be suctioned off from time to time. The catch basin can be lined with sponge-type mats which can be replaced once they are completely saturated with dirt particles, or the dirt particles can be suctioned off following a drying process.

It is also possible to vaporize the condensation water loaded with dirt particles and then discharge it, or to reuse the condensation water in a closed liquefying loop. The dirt particles and glue residues in that case are held back in a catch basin. The catch basin is emptied and cleaned from time to time.

BRIEF DESCRIPTION OF THE FIGURES

The invention is explained in the following with reference to the drawing, to which reference is made concerning all details that are important to the invention. All elements that are not critical to the immediate understanding of the invention have been omitted. The same elements shown in the different Figures are given the same reference numbers. Shown in the drawing are.

DETAILED DESCRIPTION

Figure 1:
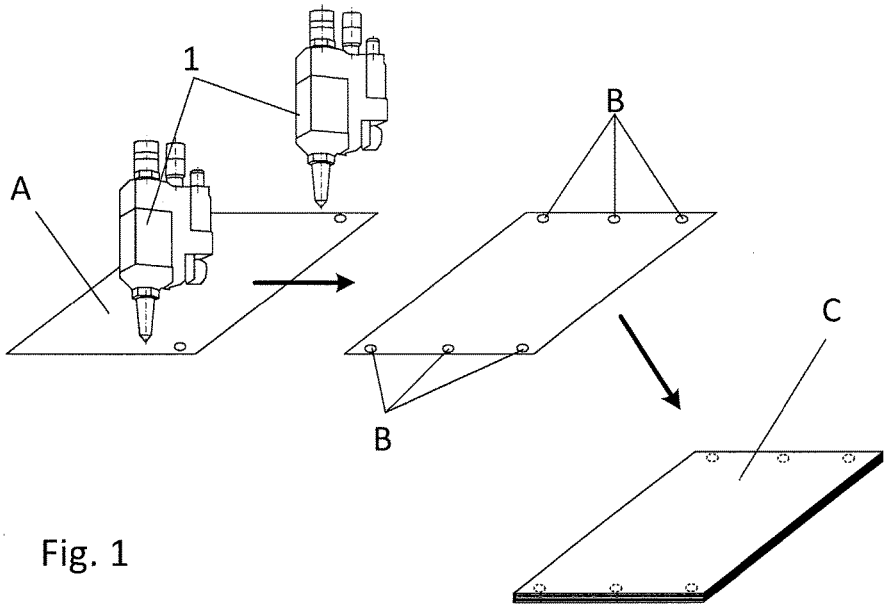
FIG. 1—A general use of a nozzle valve for applying glue points to printed products.

For a general explanation, FIG. 1 shows the use of a nozzle valve 1 for applying glue dots to printed products which are then combined to form a pre-glued book block. The glue is applied to each printed sheet or page A, wherein multiple glue points B are provided on each sheet or page. The pre-glued book block then forms a unit that is intended for further processing.

Figure 2:
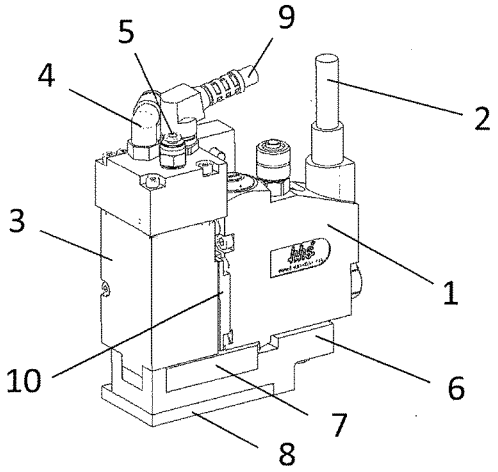
FIG. 2—A first perspective representation of the complete nozzle unit, including a nozzle valve in combination with various function-related elements.

FIG. 2 shows a perspective view from the front of a nozzle unit according to the invention for the metered pumping of glue from a nozzle.

Figure 3:
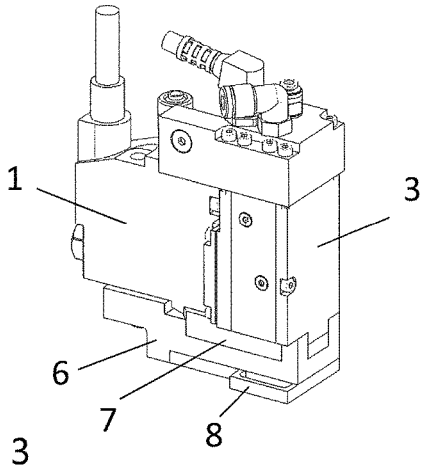
FIG. 3—A different perspective representation of the complete nozzle unit, including a nozzle valve in combination with various function-related elements.

The same nozzle unit is shown in FIG. 3 in a perspective view from the back.

The following description of the nozzle unit is based simultaneously on the FIGS. 2 and 3.

Figure 4:
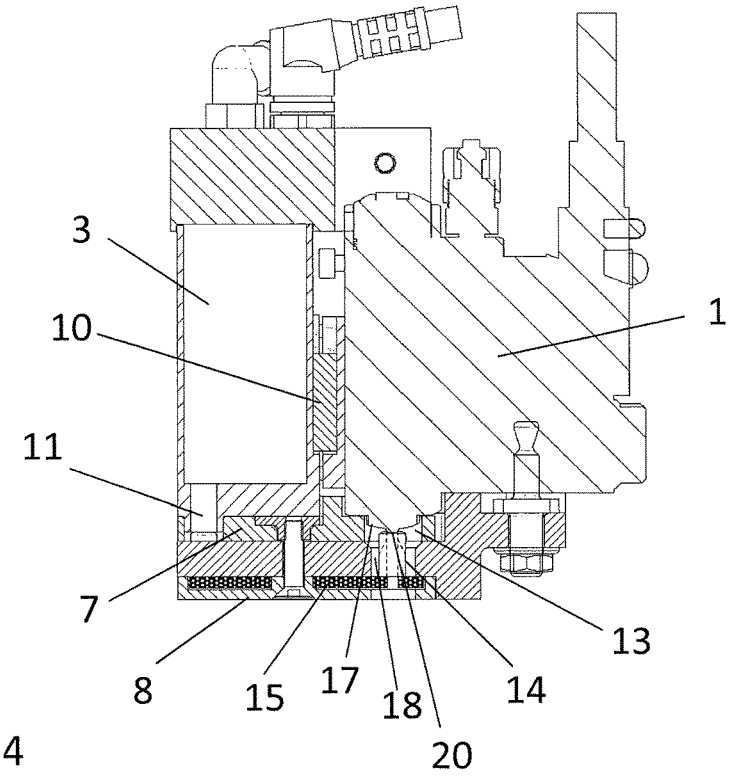
FIG. 4—A sectional view through the complete nozzle unit.

A nozzle valve 1 belonging to a nozzle unit is supplied with glue via a glue-supply line 2, wherein the nozzle valve 1 is generally connected via a connecting element 6 to a moist-air generator 3. A contact-effective Peltier element 10 is arranged between the nozzle valve 1 and the moist-air generator 3, such that this Peltier element on the one hand supplies heat to the moist-air generator 3 and, on the other hand, supplies cold to the nozzle valve 1. This Peltier element 10 or other electro-thermal converter is supplied with electrical energy via a supply 9. The moist-air generator 3 is provided with a dry air supply 4 and a water supply 5. FIG. 4 shows a sectional representation through the aforementioned nozzle unit, wherein the inside of the nozzle valve 1 is not shown in further detail herein since it is familiar to one skilled in the art.

Figure 5:
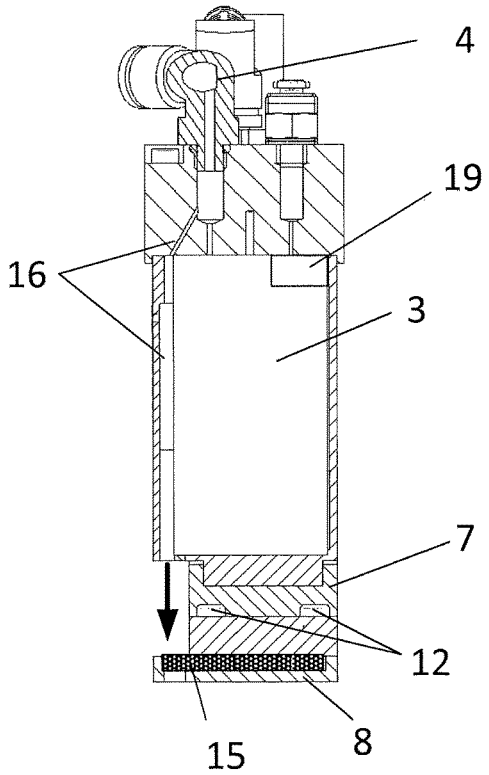
FIG. 5—A different sectional view through the complete nozzle unit, at a right angle to the representation shown in FIG. 4.

FIG. 5 shows a different sectional representation of the nozzle unit in the region of the moist-air generator, shown at a right angle to the representation in FIG. 4.

The following description of the nozzle unit is based simultaneously on FIGS. 4 and 5.

The water supply is controlled by a water supply regulator 19 which increases the amount of water that is supplied with the aid of a regulator, preferably at increased temperature in the moist-air generator 3. The dry air is heated with heat from the Peltier element 10 and is enriched with water in the moist-air generator 3. The warm, moist air then travels via a line 11 to the distributor plate 7, and the water-enriched air is pumped from there via the channels 12 in the distributor plate into a nozzle chamber 13. A nozzle end 17, that belongs to the nozzle valve 1 and is provided at its tip with a nozzle outlet opening 20, is operatively connected to the Peltier element 10 which cools the nozzle end 17, wherein condensation water forms when the nozzle end is admitted with moist air.

The condensation water, if applicable containing dissolved glue residues, flows via an opening 18 into a catch basin 8. The catch basin 8 contains a sponge 15 which catches the condensation water. A discharge device 14, which here takes the form of a protective tube, separates the opening 18 from the space required for the stream of glue to pass through, thereby ensuring that contaminated water cannot drop onto the products (paper) to which glue is applied.

The discharged condensation water is transported to a catch basin 8, arranged on the side and below the moist-air generator 3, which is provided for the operation with a sponge 15. A bore 16 is integrated into the moist-air generator 3, by means of which dry air can be branched off from the dry air supply 4. This dry air blows onto the sponge 15 in the catch basin 8, thus drying the sponge in this area. Owing to the capillary effect of the sponge, the condensation water travels within the sponge and is transported from the region where the condensation water accumulates to the region where the drying takes place.

The discharge device 14 can be provided with tangential bores through which air flows into the inside space of this discharge device, causing a swirling flow therein, preferably in the region of the nozzle outlet opening 20. In addition to the lubricating effect in the area of the nozzle outlet opening 20, this swirling air flow also results in consolidating the glue stream flowing through the center of the swirling flow because of the cyclone effect caused by the swirling flow. The swirling air flow is then discharged, as described in the above, without having a negative effect onto the glue stream.

In addition, this swirling air flow can carry along and discharge any drops of condensation water that form on the inside wall of the discharge device.

This type of situation always occurs if the outside contour of the nozzle outlet opening in circumferential direction is not sealed off completely by the inside contour of the discharge device in the circumferential direction, but if a gap remains between the contours of the two parts through which drops of condensation water can flow into the inside area of the discharge device. It is, however, possible to dimension this gap in such a way that any condensation water drops that form and adhere to the inside wall of the discharge device owing to their surface tension can be easily carried along by the swirling air flow.

Figure 6:
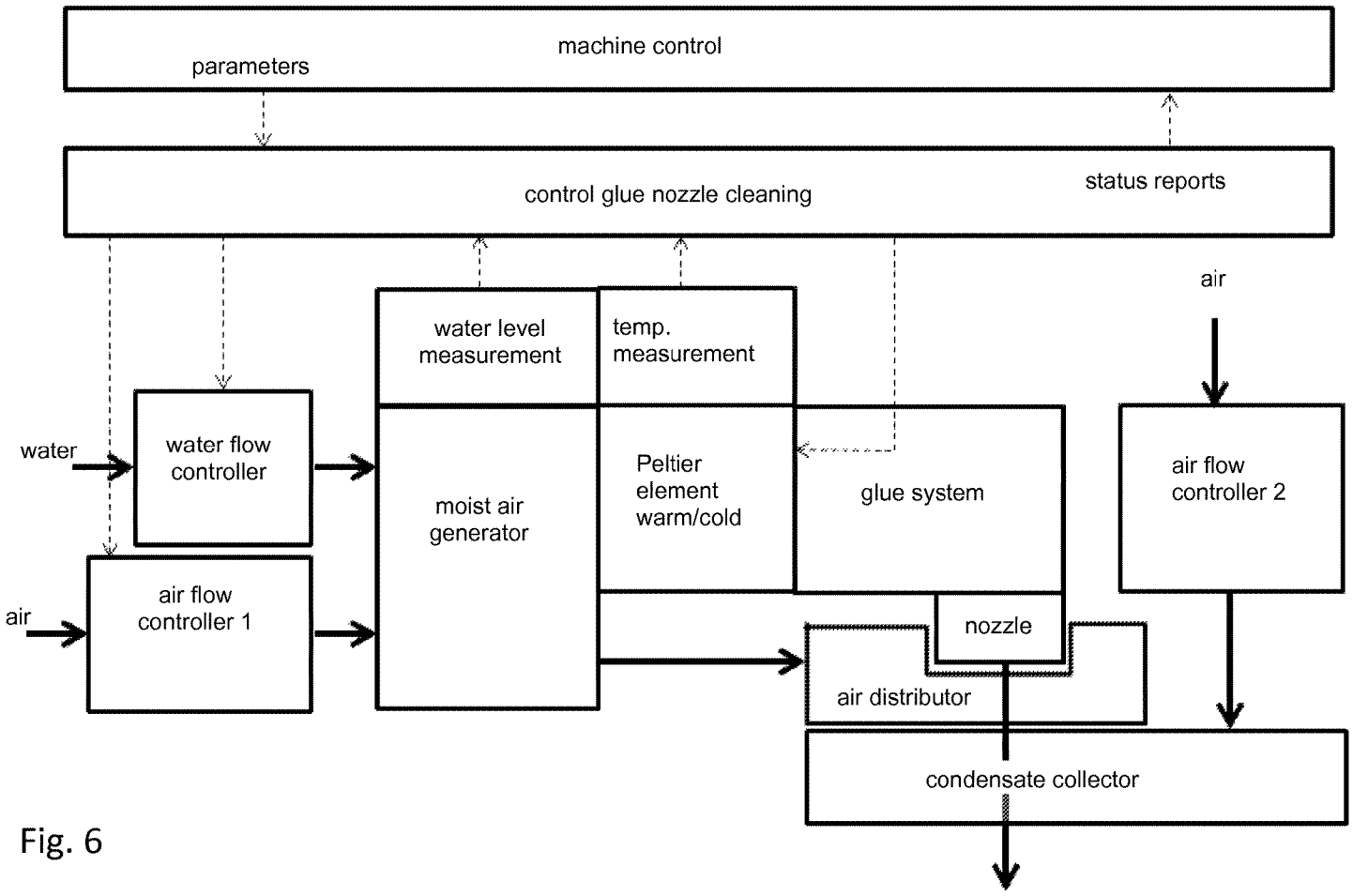
FIG. 6—A system for controlling the nozzle unit.

FIG. 6 shows a device for controlling the complete nozzle unit with the various elements and their interdependence. The interconnections and/or the interdependencies of the individual elements relative to each other follow clearly from this Figure and a repetitive description can therefore be omitted.

The invention claimed is:

1. A method for applying a flowable substance to a flat or curved product, using a nozzle unit including a nozzle valve having a nozzle end with an outlet opening, the method comprising:

admitting at least one zone on the nozzle end to at least one of moist air and temperature-moderated air and forming condensation water or condensation water loaded with dirt particles on the nozzle end when the supplied moist and/or temperature-moderated air hits the at least one zone of the nozzle end thereby preventing a drying up or agglutinating of the flowable substance at the outlet opening of the nozzle end to secure a continuous, unobstructed flow of the flowable substance from the outlet opening; and subjecting the at least one zone on the nozzle end to cooling to promote the condensation of water on the nozzle end when the supplied moist and/or temperature-moderated air hits the at least one zone of the nozzle end.

2. The method according to claim 1, wherein the admitting includes operatively connecting the at least one zone of the nozzle end to a source of moist and/or temperature-moderated air.

3. A method for applying a flowable substance to a flat or curved product, using a nozzle unit including a nozzle valve having a nozzle end with an outlet opening, the method comprising:

admitting at least one zone of the nozzle end to at least one of moist air and temperature-moderated air and forming condensation water or condensation water loaded with dirt particles on the nozzle end by cooling the nozzle end to promote condensation thereon when the supplied moist and/or temperature-moderated air hits the at least one zone of the nozzle end thereby preventing a drying up or agglutinating of the flowable substance at the outlet opening of the nozzle end to secure a continuous, unobstructed flow of the flowable substance from the outlet opening; and discharging the condensation water or the condensation water loaded with dirt particles from the nozzle end zone via a discharge device that is operatively connected to the nozzle end.

4. The method according to claim 3, including discharging and subsequently flowing off the condensation water or the condensation water loaded with dirt particles from the nozzle end via a discharge device, outside of an effective range of an end region of the nozzle outlet opening.

5. The method according to claim 3, wherein the discharging includes discharging the condensation water or condensation water loaded with dirt particles from the nozzle end via the discharge device, said discharge device including at least one flow-through opening, arranged along a circumference of the nozzle end through which at least a partial amount of the moist and/or temperature moderated air is conducted, while forming a swirling flow that is effective on an inside of the discharge device, so that the swirling flow can directly admit the nozzle outlet opening.

6. The method according to claim 1, including operatively connecting a supply line for air intended for the nozzle end zone to a fog generator or conducting the air over a fog generator.

7. The method according to claim 6, including operating the fog generator with aid of a water-fed ultrasonic atomizer.

8. The method according to 3, including collecting condensation water or the condensation water loaded with dirt particles in a catch basin.

9. The method according to claim 8, including arranging the catch basin below the nozzle outlet opening.

10. The method according to claim 1, including cooling the nozzle end directly or indirectly with aid of a cooling agent.

11. The method according claim 1, including respectively cooling the nozzle end and heating the air with an electro-thermal converter.

12. The method according to claim 11, wherein the electro-thermal converter comprises at least one Peltier element.

13. The method according to claim 3, wherein the flowable substance is glue that exits the nozzle outlet opening in a stream and the discharge device comprises a collecting tube arranged on one side of the nozzle opening, the method further including blowing a stream of air, which has a neutral effect on the consistency of the exiting stream of glue, from another side of the nozzle outlet opening against the nozzle outlet opening to blow away the condensation water or condensation water loaded with dirt particles that accumulates in a region of the nozzle outlet opening; and collecting condensation water in the collecting tube, and subsequently discharging the collected condensation water.

* * * * *